US006553778B2

(12) United States Patent
Tipton et al.

(10) Patent No.: US 6,553,778 B2
(45) Date of Patent: Apr. 29, 2003

(54) MULTI-STAGE REFRIGERATION SYSTEM

(75) Inventors: Russ Tipton, Westerville, OH (US); Terry Bush, Westerville, OH (US); Mike Graham, Delaware, OH (US); Jack Saunders, Grove City, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/760,561

(22) Filed: Jan. 16, 2001

(65) Prior Publication Data

US 2002/0092318 A1 Jul. 18, 2002

(51) Int. Cl.[7] ..... F25B 41/00
(52) U.S. Cl. ..... 62/196.1; 62/524; 62/525
(58) Field of Search ..... 62/196.1, 196.2, 62/524, 525

(56) References Cited

U.S. PATENT DOCUMENTS

| | | | | | |
|---|---|---|---|---|---|
| 2,153,695 | A | * | 4/1939 | Philipp | 236/44 R |
| 3,866,439 | A | * | 2/1975 | Bussjager et al. | 62/504 |
| 4,018,584 | A | | 4/1977 | Mullen | 62/175 |
| 4,051,691 | A | | 10/1977 | Dawkins | 62/236 |
| 4,084,388 | A | * | 4/1978 | Nelson | 62/152 |
| 4,332,137 | A | * | 6/1982 | Hayes, Jr. | 62/151 |
| 4,474,026 | A | * | 10/1984 | Mochizuki et al. | 62/157 |
| 5,307,645 | A | * | 5/1994 | Pannell | 62/244 |
| 5,444,971 | A | * | 8/1995 | Holenberger | 60/728 |
| 5,548,968 | A | * | 8/1996 | Sada | 62/196.2 |
| 5,687,579 | A | * | 11/1997 | Vaynbberg | 62/175 |
| 5,768,903 | A | * | 6/1998 | Sekigami et al. | 62/196.2 |
| 5,996,363 | A | * | 12/1999 | Kurachi et al. | 62/192 |
| 6,026,654 | A | * | 2/2000 | Park | 62/196.1 |
| 6,034,872 | A | * | 3/2000 | Chrysler et al. | 62/259.2 |
| 6,067,482 | A | * | 5/2000 | Shapiro | 307/64 |
| 2001/0037650 | A1 | * | 11/2001 | Scheufler et al. | 62/115 |

FOREIGN PATENT DOCUMENTS

JP 410009693 A * 1/1998 ..... F25B/1/00

* cited by examiner

*Primary Examiner*—William E. Tapolcal
*Assistant Examiner*—Mohammad M. Ali
(74) *Attorney, Agent, or Firm*—Howrey Simon Arnold & White, LLP

(57) ABSTRACT

A multi-stage cooling system is disclosed. The multi-stage cooling system is capable of providing a plurality of cooling capacities. The cooling system has a plurality of independently operable compressors. A control system operates the compressors to provide a cooling capacity corresponding to the heat load of a space to be cooled. A condenser structure of the cooling system has a plurality of individual condenser coils. Each condenser coil has an independent refrigerant path receiving compressed refrigerant from one of the compressors. An evaporator structure of the cooling system has a plurality of individual evaporator coils. Each evaporator coil has an independent refrigerant path receiving condensed refrigerant from a corresponding condenser coil via an expansion mechanism and returning refrigerant to an input of a corresponding compressor.

22 Claims, 10 Drawing Sheets

MULTI-STAGE REFRIGERATION SYSTEM

BACKGROUND OF THE INVENTION

In a conventional vapor compression refrigeration cycle, a compressor mechanically elevates the temperature and pressure of a working fluid to achieve a desired vapor state. A heat exchanger, designated as a condenser, dissipates heat from the compressed working fluid, thereby condensing the working fluid. An expansion valve or other expansion apparatus lowers the pressure of the working fluid, and the working fluid enters a second heat exchanger, designated as an evaporator, in which heat from the environment to be cooled is absorbed by the working fluid. The now heated working fluid returns to the compressor, and the cycle is repeated. The present invention is directed in part to a novel adaptation of the conventional vapor compression refrigeration cycle.

A vapor compression refrigeration system ("cooling system") is selected so that its heat removal (or cooling) capacity matches the heat load generated by the space that is to be cooled. The heat load of the space to be cooled will vary according to various factors, including, for example, the season (outdoor temperature), equipment operating within the space, number of people present in the space, etc. Additionally, there are two types of heat that contribute to the heat load. Sensible heat is the heat that produces an increase in temperature of the air in the space to be cooled. Sensible cooling therefore reduces the temperature of the space to be cooled. Latent heat is the heat required to effect a change in the vapor state of the moisture contained in the air of the space to be cooled. Latent cooling therefore reduces the humidity of the space to be cooled.

To provide adequate cooling under all circumstances, the cooling system must have a capacity at least equal to the maximum heat load of the space to be cooled. However, this will result in selection of a cooling system with a capacity larger than required for most operating conditions. If the cooling system is operating at significantly less than its rated capacity, the system will repeatedly cycle on and off, which is undesirable in that it causes undue wear on various cooling system components. This repeated on-off cycling results in short run times which prevent the system from reaching steady-state operation. Conversely, if a cooling system is selected that has a capacity less than the maximum load, under peak load conditions the system will operate continuously. Continuous operation is also undesirable in that it causes undue component wear, increased energy consumption, and fails to provide adequate capacity to maintain the desired environmental conditions. The capacity of the cooling system must be selected to harmonize these two conflicting conditions.

It is therefore desirable to provide a cooling system that provides multiple stages of cooling, i.e., that can accommodate different loads without undesirably short or undesirably long run times. By providing a cooling system comprising multiple cooling circuits having different capacities, it is possible to provide such a multi-stage cooling system. By operating various combinations of the cooling circuits, different cooling capacities may be obtained. It then becomes necessary to determine what designs of condensers, evaporators, and controllers will allow for operation without creating unbalanced loads, compressor overloading, condensate entrainment, undesirably short or undesirably long run times, or other negative side effects.

SUMMARY OF THE INVENTION

To address the desire for a cooling system capable of providing a plurality of different cooling capacities, the present invention is directed to an integrated cooling system comprising at least two cooling circuits having independent working fluid circuits under a common control. The present invention is particularly directed to a multi-circuit cooling system in which a first cooling circuit has a different cooling capacity than a second cooling circuit. In accordance with the present invention, it is desirable to provide a condenser having multiple individual condenser coils within a common structure with the coils being arranged in a face-split relation relative to airflow through the condenser, i.e., so that the airstream passes through the individual condenser coils in parallel. Both air-cooled condensers and water-cooled condensers may be used with the present invention. It is also desirable to provide an evaporator having multiple individual evaporator coils within a common structure, with the evaporator coils being arranged in a row-split relation relative to airflow through the condenser, i.e., so that the airstream passes through the first evaporator and second evaporator coil in series.

The present invention is also particularly adapted to providing cooling based on the sensible heat load and latent heat load of the space to be cooled. The control system of the cooling apparatus in accordance with the present invention is therefore adapted to control the individual cooling circuits based on both temperature and humidity. The controller is also adapted to minimize the amount of compressor cycling required to maintain the environment at the desired temperature and humidity.

Although the present invention is disclosed in the context of an integrated cooling system having two cooling circuits under common control, it is to be understood that the invention encompasses cooling systems having any number of cooling circuits. Furthermore, although the detailed design and construction of such systems would be a time-consuming undertaking, it would nonetheless be within the capabilities of one having ordinary skill in the art and the benefit of this disclosure.

DESCRIPTION OF ILLUSTRATIVE EMBODIMENTS

Figure 1:
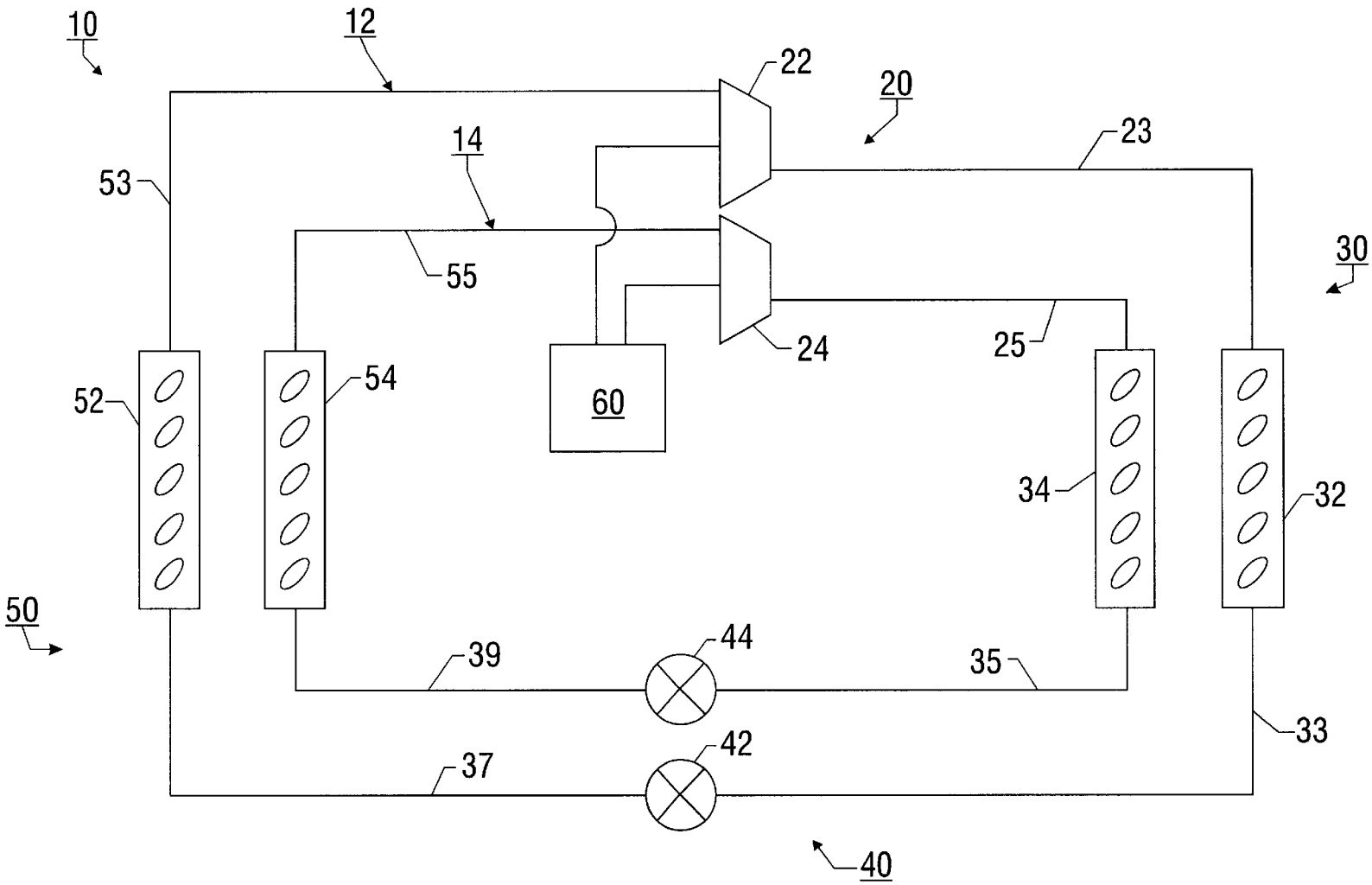
FIG. 1 is a schematic diagram of a multi-stage cooling system in accordance with the present invention.

A refrigeration system 10 in accordance with the present invention is illustrated in FIG. 1. Refrigeration system 10 comprises two separate cooling circuits, a first cooling circuit 12 and a second cooling circuit 14. The individual cooling circuits 12 and 14 are of differing capacities, thus the system may provide varying degrees of cooling by operating different combinations of the two cooling circuits. For example, a relatively lesser degree of cooling may be accomplished by operating only the smaller cooling circuit. An intermediate level of cooling may be accomplished by operation of only the larger cooling circuit. Finally, a relatively higher degree of cooling may be accomplished by simultaneous operation of the both circuits. For the purposes of the description herein, first cooling circuit 12 will be designated as the circuit of relatively lesser capacity, while second cooling circuit 14 will be designated as the circuit of relatively greater capacity.

Refrigeration system 10 includes compressing system 20, comprising first compressor 22 and second compressor 24 for use with the first and second cooling circuits, respectively. Refrigeration system 10 also includes condenser 30, comprising condenser coils 32 and 34 for use with the first and second cooling circuits; expansion system 40, comprising first and second expansion mechanisms 41 and 42 for use with the first and second cooling circuits; and evaporator 50, further comprising evaporator coils 52 and 54 for use with the first and second cooling circuits. Working fluid for use in refrigeration system 10 may be any chemical refrigerant, such as chloroflourocarbons (CFCs), hydrochloroflourocarbons (HCFCs), or hydroflourocarbons (HFCs). The system described herein is particularly adapted for use with R-22.

To achieve multiple stages of cooling, the system may be operated in three different modes. When a low cooling capacity is required, only first cooling circuit 12 is used, meaning that only compressor 22 is operated. Because second cooling circuit 14 is not required, compressor 24 is idle. When an intermediate cooling capacity is required, second cooling circuit 14 is operated alone, meaning that compressor 24 is operated, while compressor 22 is idle. Finally, a high cooling capacity is accomplished by simultaneous operation of both cooling circuits, meaning that both compressors are operated simultaneously.

In one embodiment of the multi-stage cooling system of the present invention, first cooling circuit 12 has a cooling capacity of 3 tons, while second cooling circuit 14 has a cooling capacity of 5 tons. The lowest cooling capacity that may be provided by this embodiment is 3 tons. The intermediate cooling capacity provided by this embodiment is a cooling capacity of 5 tons. Finally, the highest cooling capacity, which occurs when both circuits are in simultaneous operation, is 8 tons.

Beginning at compressing system 20, first cooling circuit 12 includes a first compressor 22, and second cooling circuit 14 includes compressor 24. Compressors 22 and 24 are independently operable compressors of unmatched sizes chosen in accordance with the cooling capacities of the corresponding cooling circuits. Unless otherwise indicated, the capacities of all system components and interconnection conduits are chosen based on the capacity of the corresponding cooling circuit in accordance with standard design principles known to those of ordinary skill in the art. Controller 60 is the common controller for the system and is connected to compressors 22 and 24, and operates the compressors to produce the desired degree of cooling. Controller 60 is preferably a microprocessor-based controller programmed to operate as described in greater detail below. Controller 60 could also comprise a plurality of microprocessor based controllers connected via a network and inter-operating to provide the control functions described herein.

After the working fluid is compressed, it travels through interconnection conduits to condenser 30. The two cooling circuits have separate refrigerant paths throughout the cooling system. Working fluid from the first cooling circuit travels to condenser 30 through conduit 23, while working fluid from second cooling circuit 14 travels through conduit 25. Condenser 30 comprises two separate heat exchanger coils. Condenser coil 32 operates with first cooling circuit 12, while condenser coil 34 operates with second cooling circuit 14. Condenser coils 32 and 34 are designed so that their heat transfer parameters correspond to the transfer capacities of their respective cooling circuits. In each condenser coil, heat from the working fluid is dissipated to an external heat sink. It is desired that his heat sink be a constant rejection heat sink. Details of various condenser embodiments that meet this requirement are described below.

Referring again to FIG. 1, upon leaving condenser 30, working fluid of the first and second cooling circuits travels through interconnection conduits 33 and 35 to expansion system 40. Expansion system 40 comprises expansion mechanism 42, corresponding to first cooling circuit 12, and expansion mechanism 44, corresponding to second cooling circuit 14. The working fluid is subjected to a pressure drop as it passes through expansion mechanism 40. Expansion mechanisms that may be used include valves, orifices, and other apparatus known to those of ordinary skill in the art.

Upon leaving the expansion system, heat transfer fluid for the first and second cooling circuits travels through interconnection conduits 37 and 39, respectively, arriving at evaporator 50. Evaporator 50 comprises two separate heat exchanger coils, one for each cooling circuit. Evaporator coil 52 is used with first cooling circuit 12 and is sized to have an appropriate heat exchange capacity based on the cooling capacity of the first cooling circuit. Similarly, evaporator coil 54 is used with second cooling circuit 14, and is sized to have a corresponding capacity. As the working fluid passes through evaporator 50, it absorbs heat from the environment to be cooled. Air from the environment to be cooled is circulated through evaporator coils 52 and 54, where the air is cooled by heat exchange with the working fluid. Additional details concerning the evaporator configuration are provided below. Upon leaving the evaporator, working fluid carrying the heat extracted from the environment returns to compressing system 20, thereby completing the refrigeration cycle.

Figure 2:
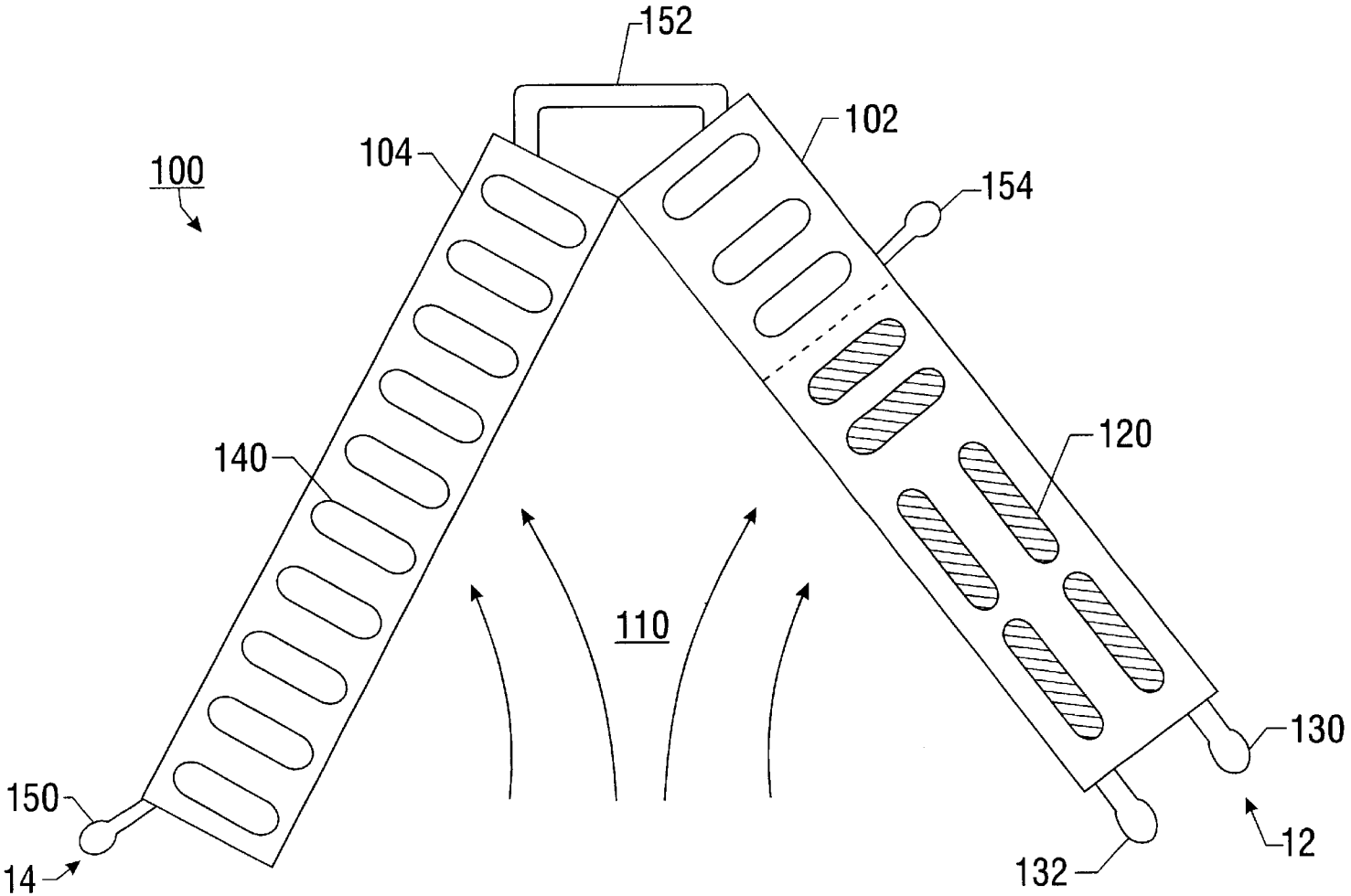
FIG. 2 illustrates one condenser coil configuration that may be used with the multi-stage cooling system of the present invention.

FIG. 2 schematically depicts one condenser that may be used with the multi-stage cooling system of the present invention. Condenser 100 comprises coil structures 102 and 104. The coil structures 102, 104 are situated so that airflow 110 moves through them in the direction illustrated by the arrows. Condenser 100 also comprises two condenser coils 120 and 140, which have independent working fluid flow paths. Condenser coil 120 is used as the condenser for first cooling circuit 12 described in FIG. 1, and condenser coil 140 is used as the condenser for second cooling circuit 14 described in FIG. 1. Condenser coil 120 comprises two thirds of coil structure 102. Condenser coil 140 comprises the remaining one-third of condenser structure 102 and the entirety of condenser structure 104. Therefore, condenser coil 120 comprises approximately one-third of condenser 100 and condenser coil 140 comprises approximately two-thirds of condenser 100.

Because the two individual condenser coils 120, 140 may be operated independently (either condenser may be operated individually or the two may be operated simultaneously), it is preferable that condenser 100 be designed so that the heat transfer properties of each individual condenser coil be relatively independent of whether the other condenser coil is in operation, i.e., that a constant heat rejection sink be available to each condenser. The constant heat rejection sink is provided by furnishing the same volume of airflow at the same temperature to the two condenser coils, which is accomplished by the structure illustrated in FIG. 2. Because each condenser coil 120, 140 receives airflow 110 at the same temperature and velocity, each coil has a constant condensing capacity regardless of whether the other condenser coil is in operation.

Condenser coil 120 is used as a condenser for first cooling circuit 12 described in FIG. 1. Working fluid from first cooling circuit 12 enters condenser coil 120 through connection conduit 130, passes through condenser coil 120, and exits through connection conduit 132. Similarly, condenser coil 140 is used as a condenser for second cooling circuit 14 described in FIG. 1. Working fluid enters condenser coil 140 through connection conduit 150, passes through the portion of coil 140 comprising condenser structure 104, and exits into interconnection conduit 152. The working fluid passes through interconnection conduit 152 and enters the condenser structure 102. The working fluid passes through the remaining portion of condenser coil 140 in condenser structure 102 and exits through interconnection conduit 154.

Because the two individual condenser coils 120, 140 each receive airflow 110 directly across their faces, this configuration may be described as face split. This face split construction results in first cooling circuit 12 receiving approximately 33% of the total condenser capacity. Second cooling circuit 14 receives the remaining 67% of the total capacity. In the disclosed example, having 3-ton and 5-ton circuits, this condenser design closely matches the capacity of each coil to the cooling capacity of each corresponding cooling circuit. If other capacities are desired, the coil split may be chosen to match the required capacities by providing condenser tubing rows that are face-split relative to the airflow with a surface area ratio approximately equal to the ratio of the cooling circuit capacities. Alternatively, if it is desired to use more than two cooling circuits, the condenser may be constructed to include any number of individual condenser coils, and the condenser coils may occupy a percentage of the total condenser corresponding to the relative capacities of the multiple cooling circuits.

Figure 3:
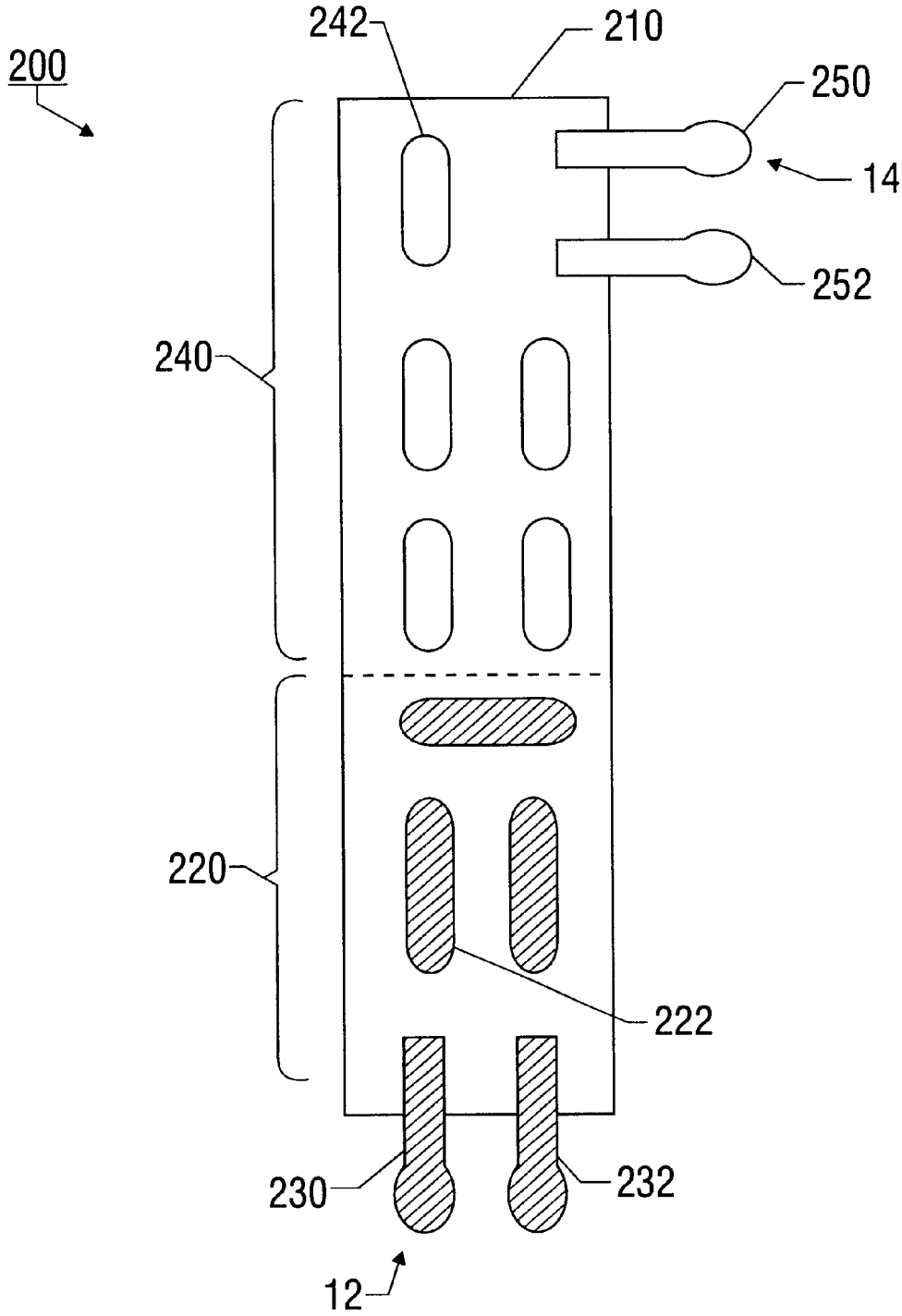
FIG. 3 illustrates another possible condenser coil configuration that may be used with the multi-stage cooling system of the present invention.

Another condenser embodiment that may be used in the multi-stage cooling system of the present invention is illustrated in FIG. 3. Condenser 200 is optimized for use as an indoor, air-cooled condenser. Condenser 200 has a condenser structure 210 that is divided into two condenser segments 220, 240. Condenser segment 220 has a condenser coil 222 circuited throughout. Condenser coil 222 provides condensing for cooling circuit 12 described in FIG. 1. Condenser segment 240 has a condenser coil 242 circuited throughout. Condenser coil 222 provides condensing for cooling circuit 14 described in FIG. 1.

The condenser coils 222, 242 circuit throughout condenser structure 210 in order to receive airflow at constant temperature to both condenser segments 220, 240. Condenser coil 222 provides approximately 36% condensing capacity to cooling circuit 12, and condenser coil 242 provides approximately 64% condensing capacity to cooling circuit 14.

Working fluid enters condenser segment 220 from interconnection conduit 230. The working fluid travels through the condenser segment 220 in condenser coil 222, which serves as the condenser for first cooling circuit 12. Once the working fluid has traversed condenser coil 222, it leaves the condenser segment 220 through conduit 232 and continues its path through cooling circuit 12.

Similarly, working fluid from cooling circuit 14 enters condenser segment 240 from interconnection conduit 250. The working fluid travels through condenser segment 240 in condenser coil 242. Working fluid traverses the entire condenser coil 242 and exits through conduit 252 continuing its path through the remainder of cooling circuit 14.

Figure 4:
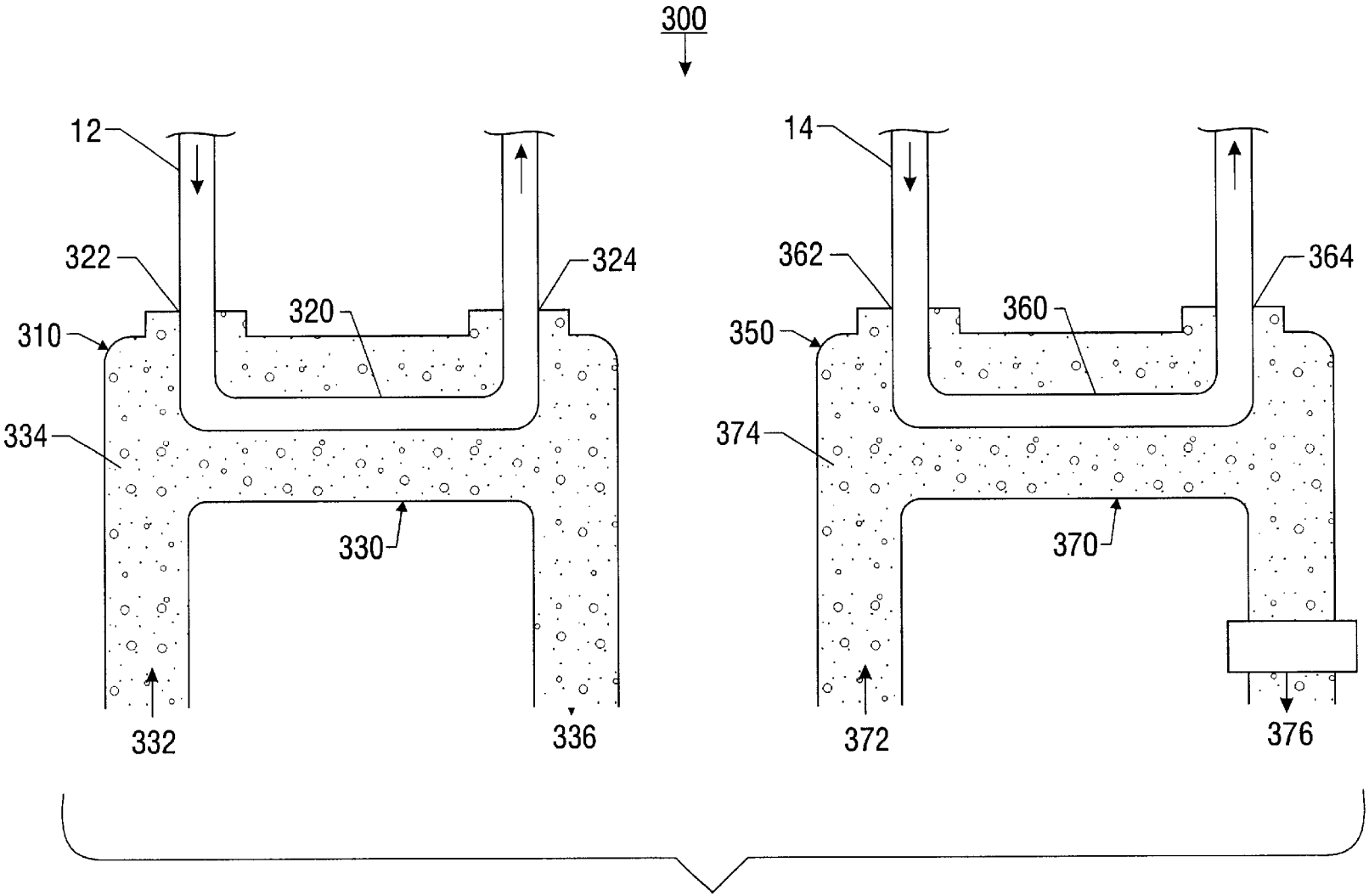
FIG. 4 illustrates yet another possible condenser coil configuration that may be used with the multi-stage cooling system of the present invention.

Yet another condenser embodiment that may be used with the cooling system of the present invention is the liquid cooled heat exchanger illustrated in FIG. 4. In this condenser, working fluid is condensed through heat exchange with a chilled liquid such as water or glycol. Condenser 300 includes individual heat exchangers 310 and 350. The heat exchangers 310, 350 are sized based on the relative capacities of the cooling circuits 12, 14 described in FIG. 1.

Heat exchanger 310 operates in conjunction with cooling circuit 12. Heat exchanger 310 includes an inner tube 320 for the working fluid of the refrigerant loop and an outer tube 330 for a chilled cooling liquid. Working fluid from cooling circuit 12 enters first heat exchanger 310 through conduit 322. Chilled cooling liquid enters the first heat exchanger through conduit 332. Working fluid passes through inner tube 320, where heat is dissipated into cooling liquid 334 within outer tube 330. After being condensed, working fluid leaves the heat exchanger through conduit 324, where it continues through first cooling circuit 12. After heat exchange with the working fluid, cooling liquid leaves heat exchanger 310 through conduit 336.

Cooling circuit 14 includes second heat exchanger 350. Second heat exchanger 350 comprises an inner tube 360 for working fluid and an outer tube 370 for chilled cooling liquid. Working fluid from second cooling circuit 14 enters second heat exchanger 350 through conduit 362, and cooling liquid enters the second heat exchanger through conduit 372. The working fluid passes through inner tube 360 dissipating heat to cooling liquid 374 within outer tube 370. The working fluid then leaves the heat exchanger through conduit 364, where it continues through second cooling circuit 14. The cooling liquid leaves second heat exchanger 310 through conduit 376.

Figure 5:
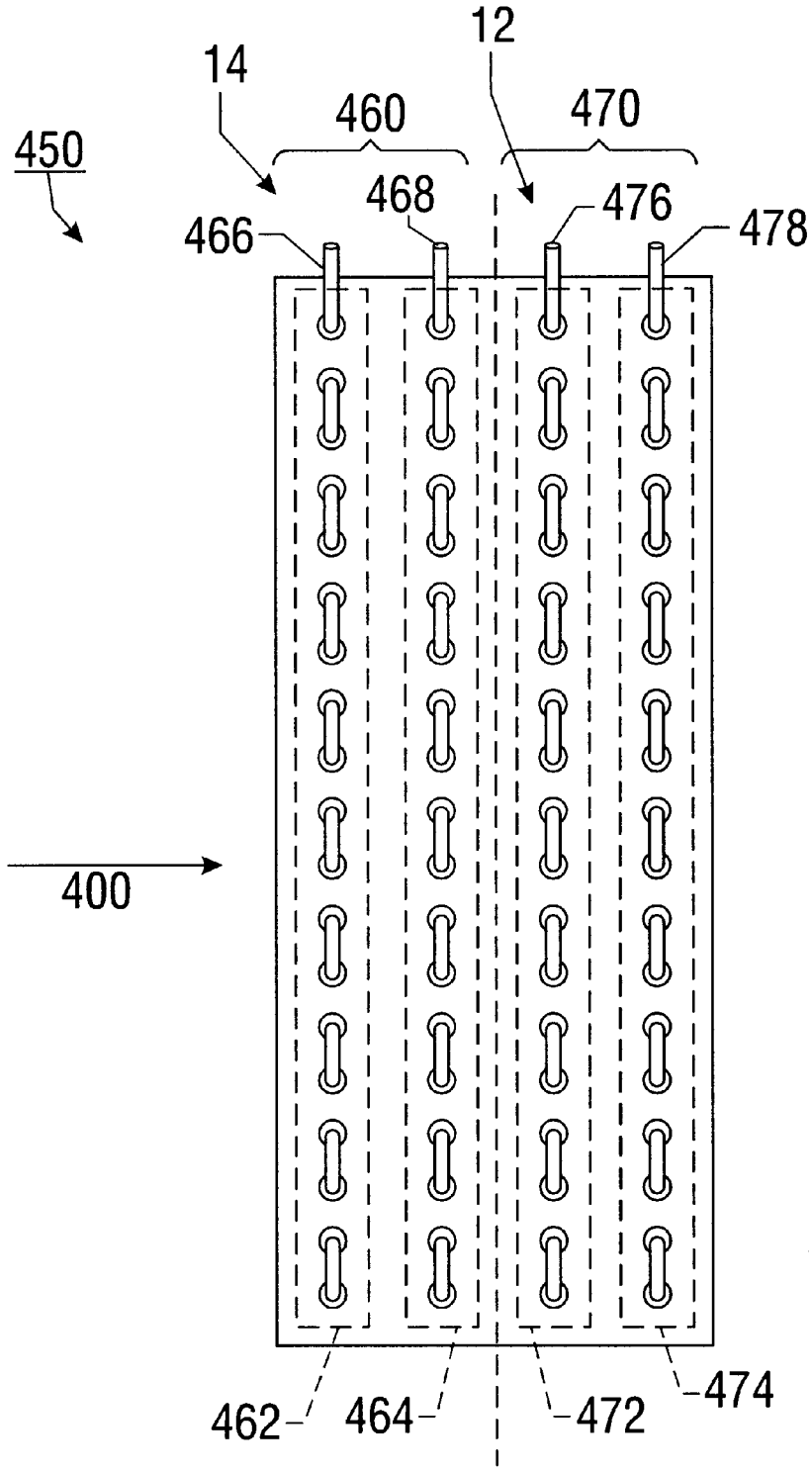
FIG. 5 illustrates an evaporator coil configuration that may be used with the multi-stage cooling system of the present invention.

Another aspect of the present invention is the construction of an evaporator 450 as illustrated in FIG. 5. Evaporator 450 comprises two individual working fluid circuit paths that are row-split, i.e., individual evaporator coils 460, 470 are arranged in series relative to airflow 400 so that each coil 460, 470 receives the entire air stream. Because each coil 460, 470 receives the entire airstream 400, whether either coil is operating individually or both coils are operating together the entire airstream is cooled, which increases the sensible cooling ratio.

The high sensible cooling ratio achieved by row-split circuiting, renders this arrangement particularly suitable for cooling electronic equipment or other sensible heat loads that do not require significant latent cooling. Furthermore, row split circuiting causes even condensation over the entire length of the heat exchanger fins, thereby minimizing the likelihood of condensate entrainment into the airstream. If the fins are not continuously wetted, dry spots occurring along the fin may induce water droplet formation, which easily results in such droplets becoming entrained in the airflow. Although a four-row evaporator 450 divided into two individual working fluid circuit paths 460, 470 is described herein, it is understood that for cooling circuits of different relative capacities, other coil arrangements, i.e., the number of rows, could be chosen to provide matching evaporator capacities.

The first two rows 462 and 464 comprise the evaporator coil 460 for second cooling circuit 14 as described in FIG. 1. Working fluid enters evaporator coil 460 through inlet 466 from the second cooling circuit 14, travels through the rows 462, 464 of evaporator coil 460, and returns to the second cooling circuit 14 through outlet 468. With airflow 400 from left to right as illustrated by the arrow, these two rows 462, 464 perform at approximately 66% of the total capacity of the entire four-row evaporator 450. This performance ratio for evaporator 460 of the second cooling circuit 14 is relatively independent of whether the first circuit 12 is in operation. This ratio closely matches the capacity ratio of second cooling circuit 14 to the total system cooling capacity in the example of 5 ton capacity for second cooling circuit 14 and of 3 ton capacity for first cooling circuit 12 with an 8 ton total capacity.

The second pair of rows 472 and 474 comprise the evaporator coil 470 for first cooling circuit 12 as described in FIG. 1. Working fluid enters evaporator coil 470 through inlet 476 from first cooling circuit 12, travels through the rows 472, 474 of evaporator coil 470, and returns to first cooling circuit 12 through outlet 478. This second pair of rows 472, 474 performs at approximately 34% of the total capacity of the four-row evaporator 450 when both cooling circuits 12, 14 are operating simultaneously. If only the first cooling circuit 12 is operating, the capacity of evaporator coil 470 increases slightly. The slight increase is due to the increase in temperature difference experienced by evaporator coil 470, because the evaporator coil 460 is not pre-cooling airflow 400 before entering the evaporator coil 470. More importantly, the evaporator coil 470 for the first cooling circuit 12 operates at approximately 100% sensible cooling when operated by itself.

Figure 6A:
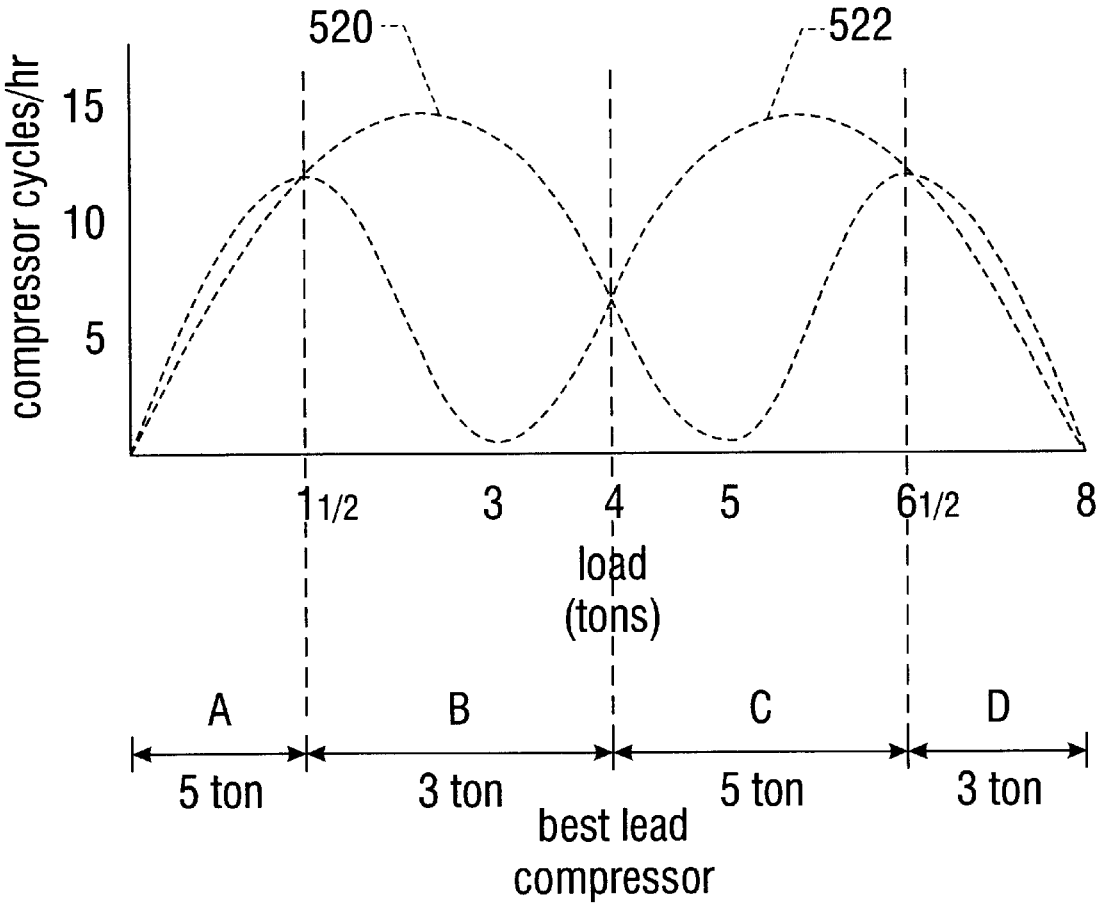
FIG. 6A is a plot of the total number of compressor cycles per hour versus cooling load for one cooling system embodiment in accordance with the present invention.

Operating a multi-stage cooling system comprising multiple cooling circuits having different capacities poses a control issue with regard to selecting the cooling circuit that may be most advantageously operated for a given load condition. For any load, a lead compressor must be selected. The lead compressor is the first compressor that will be started when a call for cooling is initiated. The other compressor, the lag compressor, will be started if the lead compressor cannot satisfy the cooling demand. It is desirable that a lead compressor be selected to minimize on/off cycling of the compressors. For the example embodiment discussed above having 3-ton and 5-ton cooling circuits, FIG. 6A is a graph plotting the total number of compressor cycles required to maintain a desired temperature regulation versus the heat load on the system. FIG. 6A is based on a 4,000 $ft^3$ room with typical transport characteristics. Although quantitative cycle rates may vary for different conditions, the relative qualitative results will remain the same. Although the following description is in the context of the example cooling system having cooling circuits with 3-ton and 5-ton capacities, the control technique is equally applicable to cooling circuits having other capacities.

The graph in FIG. 6A shows simulated results for the compressor cycling rate versus differing room loads. Curve 520 in FIG. 6A represents the compressor cycling rate for loads between 0 and 8 tons if the 5-ton compressor is used as the lead compressor. Curve 522 represents the compressor cycling rate for loads between 0 and 8 tons if the 3-ton compressor is used as the lead compressor. For loads of up to 1.5 tons, depicted as range A, it is preferable to use the 5-ton compressor as the lead compressor, which results in fewer compressor cycles per unit time. For loads between 1.5 tons and 4 tons (range B), the 3-ton compressor is the preferred lead compressor to minimize compressor cycles per unit time. For loads between 4 tons and 6.5 tons (range C), the 5-ton compressor is again the preferred lead compressor to minimize compressor cycling. Finally, for loads of 6.5 tons to 8 tons (range D), the 3-ton compressor is the preferred lead compressor.

As may be seen from FIG. 6A, a reasonable approximation of the optimal lead compressor selection may be obtained by selecting the 3-ton compressor as the lead compressor for loads less than 4 tons and by selecting the 5-ton compressor as the lead compressor for loads greater than 4 tons.

Figure 6B:
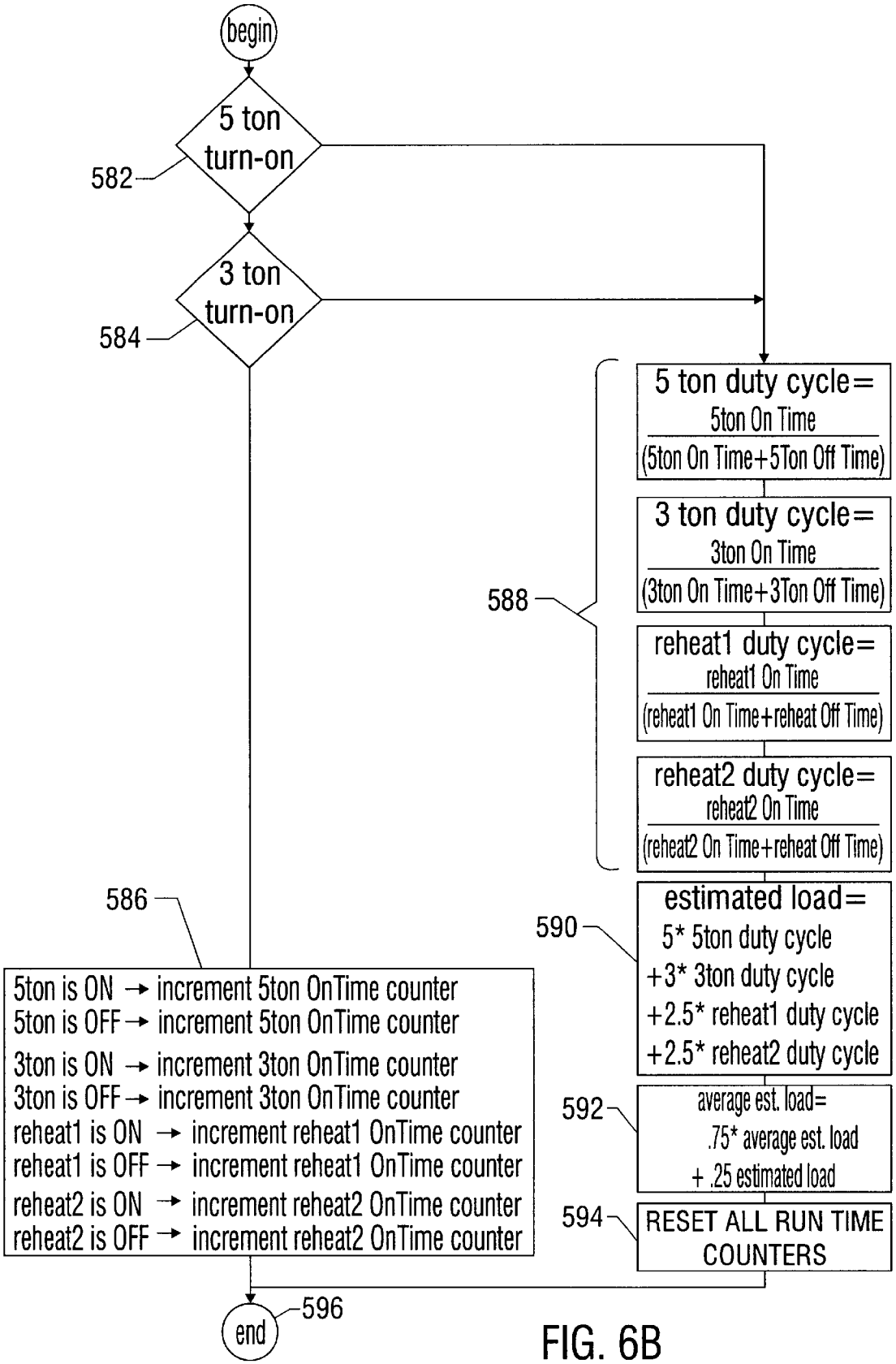
FIG. 6B diagrams a process for computing the loads and duty cycles at every compressor cycle.

The selection algorithms disclosed below for determining the lead compressor rely on a calculation of load from the compressor and re-heater duty cycles. These loads and duty cycles are computed according to the diagram in FIG. 6B at every compressor on-off cycle. If neither compressor is cycled during a given iteration, then the appropriate run time counters are incremented (586). If either compressor is cycled, then the duty cycles for the compressors and re-heaters are computed (588). The duty cycles are calculated as a ratio of the on-time count versus the sum of the on-time count and the off-time count, i.e., the total time count. For example, the 5-ton duty cycle is calculated by taking the count or number of cycle iterations in which the 5-ton compressor was on and dividing that count by the entire count of cycle iterations. The calculated duty cycles of the 5-ton compressor, 3-ton compressor, first re-heater and second re-heater are then used to calculate the estimated load on the system (590).

The calculated load is simply a weighted sum of the respective duty cycles. Specifically, the estimated load can be calculated as five times the 5-ton duty cycle plus three times the 3-ton duty cycle minus two and one-half times the sum of the re-heater duty cycles. (Each of the re-heaters has a capacity of 2½ tons.) The calculated load is then subjected to an arithmetic low pass filter to (weighted average) eliminate noise (592). The filter calculates a new average estimated load by adding three-fourths of the previous average estimated load and one-fourth of the estimated load calculated on the present cycle. These load values are then used to select the lead compressor as described above with reference to FIG. 6A.

Figure 7:
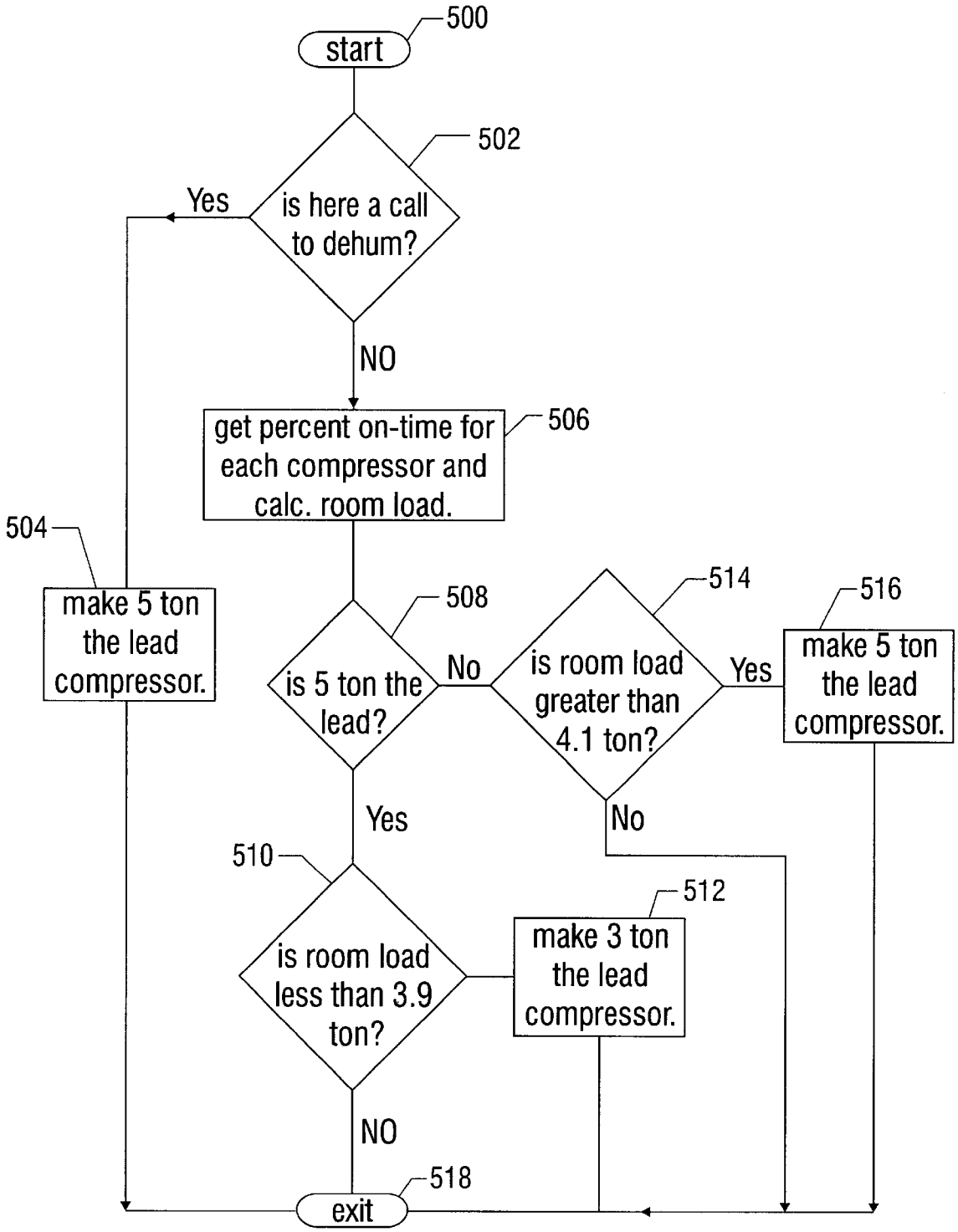
FIG. 7 is a flow chart illustrating one control technique for a cooling system in accordance with the present invention.

In addition to minimizing on-off cycling of the compressors, it is desirable that the controller provide good temperature and humidity regulation. One such method of operating multiple cooling circuits is illustrated in the flow chart of FIG. 7. The identified control technique periodically determines the average load for the cooling system and selects the lead compressor based on the average cooling requirement. Initially, the 3-ton compressor is selected as the lead compressor (500), although the 5-ton compressor could be selected as the initial lead compressor without affecting the algorithm. If the lead compressor cannot satisfy the sensible cooling demand (i.e., temperature control), the lag compressor is also called. Periodically, the controller will determine whether the lead compressor should be changed based on the total load.

The controller determines whether there is a need for additional dehumidification, i.e., latent cooling (502). The controller includes a humidity setpoint as well as a temperature setpoint. In the initial mode of operation, the controller operates in temperature control mode. However, if in this temperature control mode the humidity cannot be kept within the desired range, then the controller enters a humidity control mode. In the humidity control mode the 5-ton compressor is selected as the lead compressor (504), and the present control cycle ends (518). If additional dehumidification is not required, then the controller calculates the heat load of the room and selects the lead compressor to minimize on-off cycling (506). Details of these calculations are described above.

After calculating the room load, the controller determines whether the 5-ton compressor is currently selected as the lead compressor (508). If so, the controller determines whether the room load is less than 3.9 tons (510). If the room load is less than 3.9 tons, then the 3-ton compressor is selected as the lead compressor (512), completing the control cycle (518). If the room load is not less than 3.9 tons, the controller leaves the 5-ton compressor as the lead compressor, completing the control cycle (518).

If the 5-ton compressor is not currently set as the lead compressor (508), then the controller determines whether the room load is greater than 4.1 tons (514). If so, then the 5-ton compressor is selected as the lead compressor (516), completing the control cycle (518). Otherwise, the 3-ton compressor remains the lead compressor (514), completing the control cycle (518). Although the optimum switching point for the 3-ton/5-ton example embodiment is at a load of 4 tons, 3.9 and 4.1 tons are chosen as switching points to introduce hysteresis into the switching.

Figure 8:
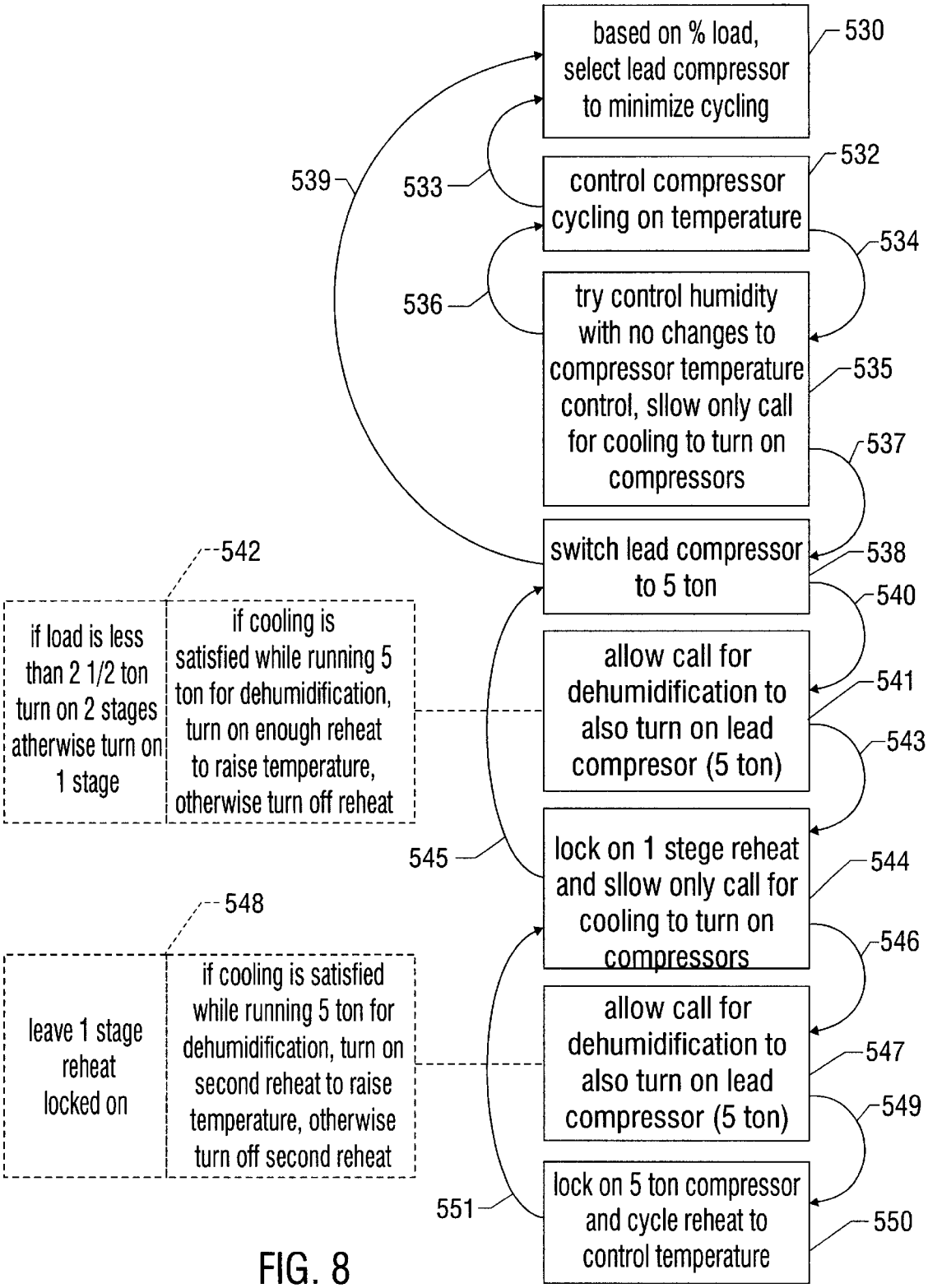
FIG. 8 is a flow chart illustrating an alternative control technique for a cooling system in accordance with the present invention.

An alternative controller embodiment is illustrated in FIG. 8. Initially, the lead compressor is selected to minimize compressor cycling, as described above with reference to FIG. 6A (530). Compressor cycling is controlled by the temperature of the cooled space (532). If no dehumidification (latent cooling) is required (533), the controller continues in this mode of operation (530 and 532). However, if the temperature control mode cannot successfully maintain the humidity within a desired range (534), then the controller attempts to control humidity with no change to the temperature control algorithm (535). If the humidity is successfully controlled (536), the compressors continue to operate based on temperature and load as described above.

If the controller's temperature control mode is unsuccessful in controlling the humidity (536), the controller selects the 5-ton compressor as the lead compressor because the 5-ton unit has greater latent cooling capacity than the 3-ton unit. If the humidity returns to an acceptable range determined by the humidity set point, the controller resumes operation as described above to minimize compressor cycling.

If selecting the 5-ton compressor as the lead compressor cannot maintain the humidity in the desired range (538), then the controller attempts dehumidification by continuously running the 5-ton compressor (540). Re-heaters are used to maintain the temperature at the desired set point. If continuously running the 5-ton compressor with intermittent re-heating increases the compressor cycling beyond an acceptable level (543), then a first stage re-heater is locked on (544), and the dehumidification call for the compressor is disabled. Thus, only a temperature call will turn on the compressors. If the latent load decreases significantly (545), the method resumes by setting the 5-ton compressor as the lead compressor.

If still more latent cooling is required (546), the dehumidification call will be re-enabled (547), the first stage re-heaters will be locked on (548), and a second stage re-heater will be used for temperature control. If this results in excessive compressor cycling (550), then the 5-ton compressor is locked on, and the second stage re-heater is cycled for temperature control. If the latent load decreases significantly (551), the controller locks the first stage re-heater on and allows only a temperature call to turn on the compressors (544).

Figure 9:
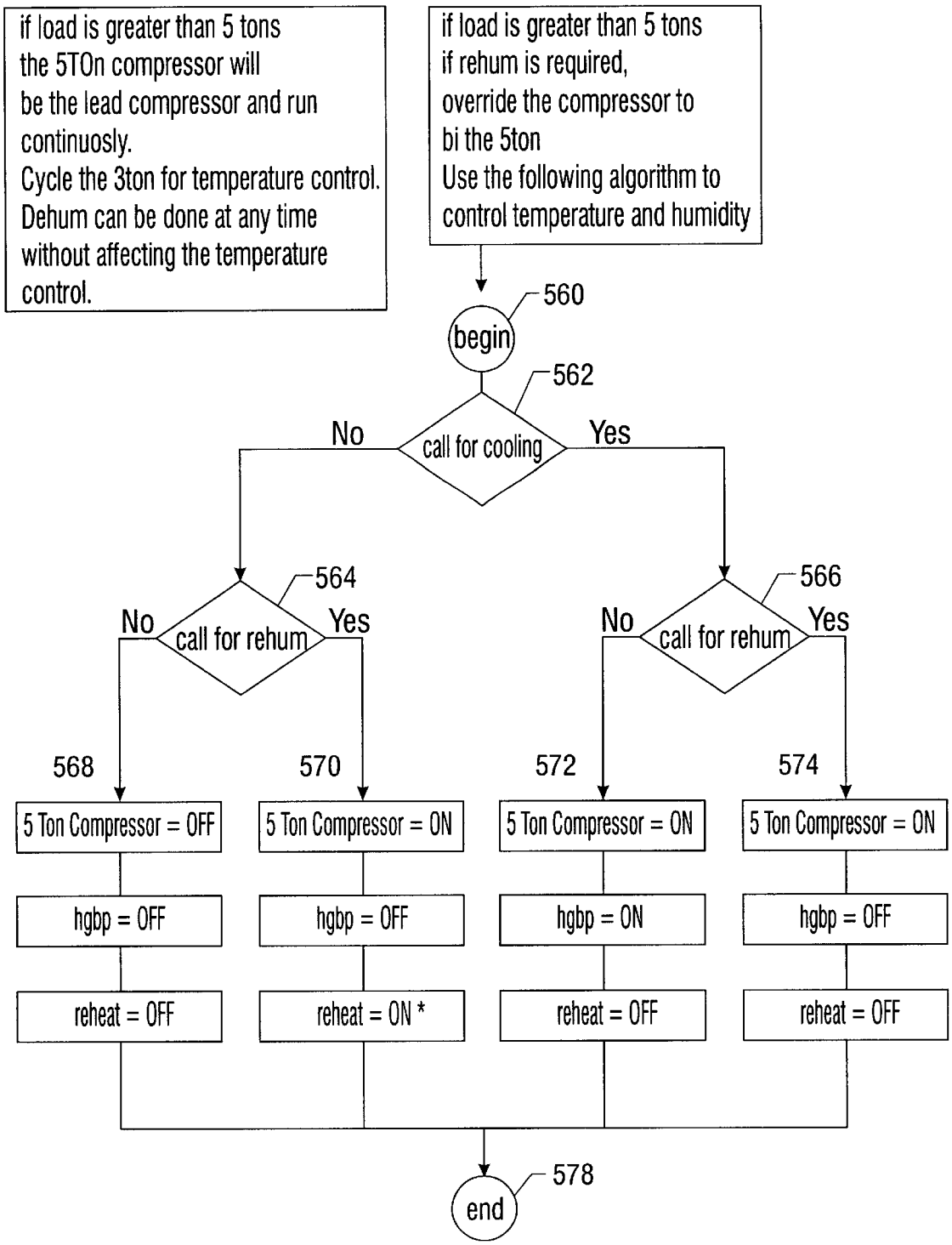
FIG. 9 is a flow chart further illustrating the method of compressor control shown in FIG. 8.

In operating the system described above, there are two possible operating scenarios, which are identified in FIG. 9. A first scenario corresponds to a load greater than 5 tons. In this case, the 5-ton compressor is operated as the lead compressor and runs continuously with the 3-ton compressor cycled for temperature control. In this state, dehumidification may be performed at any time without adversely affecting the temperature control algorithm.

Alternatively, if the load is less than 5 tons and dehumidification is required, then the 5-ton compressor is selected as the lead compressor and the algorithm illustrated in the flow chart of FIG. 9 is used for temperature and humidity control. The controller first determines whether sensible cooling (temperature control) is required (562) and whether latent cooling (humidity control) is required (564). If neither is required, the compressors and re-heaters are turned off (568). If sensible cooling (temperature reduction) is not required (562), but latent cooling (dehumidification) is required (564), then the 5-ton compressor is on and the re-heaters are turned on to maintain temperature setpoint (570). If sensible cooling (temperature reduction) is required (562) and latent cooling (dehumidification) is not required (566), then the 5-ton compressor is turned on, the hot gas bypass is on, and the re-heaters are turned off (572). Finally, if both sensible cooling and latent cooling are required, then the 5-ton compressor is turned on with the re-heaters and hot gas bypass turned off (574).

Additional modifications and adaptations of the present invention will be obvious to one of ordinary skill in the art, and it is understood that the invention is not to be limited to the particular illustrative embodiments set forth herein. Specifically, the invention is not limited to a cooling system having only two cooling circuits under common control. The system of the present invention may be expanded to include any number of cooling circuits under a common control. Furthermore, the invention is not limited to the individual capacities described herein, but rather the individual cooling circuits may be of any desired capacity, and they may be combined in any quantity to provide the desired cooling capacity. Furthermore, a cooling system according to the present invention may be expanded in capacity by adding additional cooling circuits as necessary to provide the desired capacity. It is intended that the invention embrace all such modified forms as come within the scope of the following claims.

What is claimed is:

1. A multi-stage cooling system for providing at least three cooling stages, said cooling system comprising at least two independent cooling circuits having different cooling capacities and a common control, said control operating said cooling circuits to provide environmental regulation to a single space.

2. The cooling system of claim 1 wherein a first cooling circuit has a cooling capacity of approximately one-third and wherein a second cooling circuit has a cooling capacity of approximately two-thirds.

3. The cooling system of claim 2 wherein the cooling capacity of said first cooling circuit is 3 tons, and the cooling capacity of said second cooling circuit is 5 tons.

4. The cooling system of claim 1 further comprising a condenser, said condenser comprising:

a) a first condenser coil having tubing circuited to occupy a first fraction of said condenser corresponding to the capacity of a first of said at least two cooling circuits; and b) a second condenser coil having tubing circuited to occupy a second fraction of said condenser corresponding to the capacity of a second of said at least two cooling circuits.

5. The cooling system of claim 4 wherein:

a) said first fraction is approximately one-third; and b) said second fraction is approximately two-thirds.

6. The cooling system of claim 5 wherein:

a) the capacity of said first stage is about 3 tons; and b) the capacity of said second stage is about 5 tons.

7. The cooling system of claim 4 wherein said condenser is an air-cooled heat exchanger.

8. The cooling system of claim 4 wherein said condenser is a liquid-cooled heat exchanger.

9. The cooling system of claim 1 having an evaporator comprising a plurality of evaporator coils having tubing circuits arranged in a row-split configuration relative to airflow through said evaporator.

10. The cooling system of claim 4 having an evaporator comprising a plurality of evaporator coils having tubing circuits arranged in a row-split configuration relative to airflow through said evaporator.

11. A method of providing multi-stage cooling, using a system having at least two independent cooling circuits with different capacities, said method comprising steps of:

operating only a first of said at least two cooling circuits, thereby providing a first stage of cooling;

operating only a second of said at least two cooling circuits, thereby providing a second stage of cooling greater than the first stage; and operating both the first and second cooling circuits, thereby providing a third stage of cooling.

12. A method of controlling a multi-stage cooling system, said method comprising the steps of:

determining the cooling load on said cooling system;

selecting a lead compressor to minimize compressor cycling for temperature control at said cooling load; and changing the lead compressor selection to provide additional latent cooling as required to maintain humidity at a desired set point.

13. The method of claim 12 wherein the load is calculated using the duty cycles of said compressors.

14. A multi-stage cooling system for providing at least three stages of cooling, said cooling system comprising:

a) at least two independently operable compressors having different capacities;

b) a condenser structure comprising a plurality of individual condenser coils, each condenser coil comprising an independent refrigerant path receiving compressed refrigerant from one of said compressors;

c) an evaporator structure comprising a plurality of individual evaporator coils, each evaporator coil comprising an independent refrigerant path receiving condensed refrigerant from a corresponding condenser coil via an expansion mechanism and returning refrigerant to an input of a corresponding compressor; and d) a control system operating said compressors to provide one of the at least three cooling stages corresponding to the heat load of a space to be cooled.

15. The cooling system of claim 14 wherein said condenser coils are disposed in a face split arrangement relative to said condenser structure.

16. The cooling system of claim 14 wherein said evaporator coils are arranged in a row-split arrangement relative to said evaporator structure.

17. A multi-stage cooling system for providing at least three stages of cooling, the system comprising at least two independent cooling circuits having different capacities and a common condenser, said condenser comprising:

a first condenser coil having tubing circuited to occupy a first fraction of said condenser corresponding to the capacity of a first of said at least two cooling circuits; and a second condenser coil having tubing circuited to occupy a second fraction of said condenser corresponding to the capacity of a second of said at least two cooling circuits.

18. The cooling system of claim 17 wherein:

said first fraction is approximately one-third; and said second fraction is approximately equal to two-thirds.

19. The cooling system of claim 17 wherein said condenser is an air-cooled hear exchanger.

20. The cooling system of claim 17 wherein said condenser is a liquid cooled heat exchanger.

21. A multi-stage cooling system for providing at least three stages of cooling, the system comprising at least two independent cooling circuits having different capacities and a common evaporator, said evaporator comprising a plurality of evaporator coils having tubing circuits arranged in a row-split configuration relative to airflow through said evaporator.

22. A method of providing multi-stage cooling, using a system having at least two independent cooling circuits with different capacities and a common control, said method comprising steps of:

operating only a first of the at least two cooling circuits, thereby providing a first stage of cooling;

operating only a second of the at least two cooling circuits, thereby providing a second stage of cooling greater than the first stage; and operating both the first and second cooling circuits, thereby providing a third stage of cooling.

* * * * *